US010293400B2

(12) United States Patent
Lieftucht et al.

(10) Patent No.: US 10,293,400 B2
(45) Date of Patent: May 21, 2019

(54) METHOD FOR SETTING A CONICITY OF A DIE OF A STRAND CASTING INSTALLATION, AND DEVICE FOR A STRAND CASTING INSTALLATION

(71) Applicant: SMS GROUP GMBH, Düsseldorf (DE)

(72) Inventors: Dirk Lieftucht, Düsseldorf (DE); Artemy Krasilnikov, Duisburg (DE); Felix Max Fanghänel, Dorsten (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 15/970,136

(22) Filed: May 3, 2018

(65) Prior Publication Data

US 2018/0318917 A1 Nov. 8, 2018

(30) Foreign Application Priority Data

May 3, 2017 (DE) ..... 10 2017 207 374
Jul. 28, 2017 (DE) ..... 10 2017 213 067

(51) Int. Cl.
*B22D 11/20* (2006.01)
*B22D 11/05* (2006.01)
*B22D 11/22* (2006.01)

(52) U.S. Cl.
CPC ..... *B22D 11/202* (2013.01); *B22D 11/05* (2013.01); *B22D 11/225* (2013.01)

(58) Field of Classification Search
CPC ..... B22D 11/202; B22D 11/05; B22D 11/225; B22D 11/16; B22D 11/168; B22D 11/20; B22D 11/207
See application file for complete search history.

(56) References Cited

U.S. PATENT DOCUMENTS 5,242,010 A 9/1993 Pleschiutschnigg

FOREIGN PATENT DOCUMENTS

DE 3009697 A1 10/1981
DE 3247207 A1 7/1984
(Continued)

*Primary Examiner* — Kevin P Kerns
*Assistant Examiner* — Steven S Ha
(74) *Attorney, Agent, or Firm* — Lucas & Mercanti, LLP; Klaus P. Stoffel

(57) ABSTRACT

A method for setting a conicity of a die of a strand casting installation during a casting procedure, including the steps of: measuring temperature values along a centric measuring path running in a casting direction along an adjustably disposed die wall; measuring temperature values along a peripheral measuring path running in a casting direction along the adjustably disposed die wall, wherein the peripheral measuring path runs between the centric measuring path and a lateral periphery of the die wall, and a spacing of the peripheral measuring path from the lateral periphery of the die wall is smaller than a spacing of the centric measuring path from the other lateral periphery of the die wall; determining a centric temperature distribution curve along the centric measuring path from the temperature values measured along the centric measuring path; determining a peripheral temperature distribution curve along the peripheral measuring path from the temperature values measured along the peripheral measuring path; determining a first area under the centric temperature distribution curve, and a second area under the peripheral temperature distribution curve; determining a difference between the second area and the first area; and setting the conicity of the die taking into account the difference.

3 Claims, 4 Drawing Sheets

(56) References Cited

FOREIGN PATENT DOCUMENTS

| | | | |
|---|---|---|---|
| DE | 3423475 | A1 | 11/1984 |
| DE | 3908328 | A1 | 9/1990 |
| DE | 102005024843 | A1 | 12/2006 |
| DE | 102014227013 | A1 | 3/2016 |
| EP | 0386863 | A2 | 9/1990 |
| EP | 0515010 | A2 | 11/1992 |

32
1
2
4
5
6
27
3
24
28

32
1
2
4
5
6
27
3
24
28

32
1
2
7
4
5
6
27
3
24
16
28

32
1
2
7
4
5
6
27
3
24
16
28

2
7

METHOD FOR SETTING A CONICITY OF A DIE OF A STRAND CASTING INSTALLATION, AND DEVICE FOR A STRAND CASTING INSTALLATION

CROSS-REFERENCE TO RELATED APPLICATIONS

The present application claims priority of DE 10 2017 207 374.8, filed May 3, 2017, and DE 10 2017 213 067.9, filed Jul. 28, 2017, the priority of this application is hereby claimed and these applications are incorporated herein by reference.

BACKGROUND OF THE INVENTION

The invention relates to a method for setting a conicity of a die of a strand casting installation, in particular a slab strand casting installation, during a casting procedure, comprising the following method steps: measuring temperature values along at least one centric measuring path running in a casting direction along an adjustably disposed die wall; and measuring temperature values along at least one peripheral measuring path running in a casting direction along the adjustably disposed die wall, wherein the peripheral measuring path runs between the centric measuring path and a lateral periphery of the die wall, and a spacing of the peripheral measuring path from said lateral periphery of the die wall is smaller than a spacing of the centric measuring path from the other lateral periphery of the die wall.

The invention furthermore relates to a device for a strand casting installation, in particular a slab strand casting installation, comprising: at least one die having mutually opposite, adjustably disposed die walls; at least one adjustment mechanism for adjusting the die walls; at least one actuation electronics system for actuating the adjustment mechanism; at least one centric sensor installation, connected to the actuation electronics system, for measuring temperature values along at least one centric measuring path running in a casting direction along one of the adjustably disposed die walls; and at least one peripheral sensor installation, connected to the actuation electronics system, for measuring temperature values along at least one peripheral measuring path running in a casting direction along the adjustably disposed die wall, wherein the peripheral measuring path runs between the centric measuring path and a lateral periphery of the die wall, and a spacing of the peripheral measuring path from said lateral periphery of the die wall is smaller than a spacing of the centric measuring path from the other lateral periphery of the die wall.

A respective method and a respective device are known from DE 10 2014 227 013 A1.

In the strand casting of metals in a strand casting installation, the strand width of a cast strand can be set by way of adjustable die walls on mutually opposite narrow sides of a die. The die comprises a casting passage that continues from an inlet end by way of which a metal melt is cast into the die, to an outlet end from which a strand having a strand shell and a liquid core exits, said casting passage in the cross section perpendicular to a casting direction which is defined as the direction of the metal melt flowing through the die having a rectangular shape. The strand can be configured as a slab, for example.

During cooling of the metal melt within the die, a loss of volume arises, this meaning that a cross-sectional area of the metal melt, or of the strand created therefrom, respectively, is larger at the inlet end of the die than a cross-sectional area of the metal melt, or of the strand, respectively, at the outlet end of the die. In order for a desired guiding of the metal melt, or of the strand, respectively, to be guaranteed by way of a contact with the die across the full area, the casting passage of the die is configured so as to conically taper in the casting direction. The conicity of the casting passage of the die is usually set by way of a variation in the incline of the die walls adjustably disposed on mutually opposite narrow sides. Without such a conical configuration of the casting passage of the die, the strand would no longer be guided in the lower region of the die, or in the region of the outlet end, respectively. In this instance, a controlled dissipation of heat from the strand to the usually water-cooled die walls is no longer possible. For the sake of simplicity, the conicity of the casting passage of the die in the context of the present application is referred to as the conicity of the die.

FIG. 1A shows a result in the case of an optimal conicity of a die 1. Shown is a lateral portion of the die 1 in the cross section perpendicular to the casting direction, said die 1 having two mutually opposite die walls 2 which are in each case assigned to one broad side of the die 1. Moreover, the die 1 has two mutually opposite, adjustably disposed eyeballs 3 which in each case are assigned to a narrow side of the die 1, and of which only one die wall 3 is shown in FIG. 1A. A strand 4 which has a strand shell 5 and a core 6 of liquid metal is guided through the die 1. The strand 4 bears on the entire area of the die walls 2 and 3, and on account thereof is guided in an optimal manner and simultaneously cooled by means of the die walls 2 and 3.

FIG. 1B shows a result in the case of an inadequate conicity of a die 1. On account thereof, the strand 4, or the strand shell 5, respectively, bulges outwards on the narrow sides, and the strand 4 simultaneously flattens towards the periphery, thus having a lesser thickness at said periphery than in a central region. Moreover, the periphery of the strand 4 no longer bears on the die walls 2 and 3 across the entire area such that the strand 4 is not guided in an optimal manner and is non-uniformly cooled by means of the die walls 2 and 3.

FIG. 1C shows a result in the case of an excessive conicity of a die 1. On account thereof, a concavity 6 arises on a narrow lateral face of the strand 4, or of the strand shell 5, respectively, and longitudinal depressions 7 near the periphery, the so-called rain gutters, arise on the broad sides of the strand 4. On account thereof, the narrow sides and the peripheral portions of the broad sides of the strand 4 no longer bear on the die walls 2 and 3 across the entire area such that the strand 4 is not guided in an optimal manner and is non-uniformly cooled by means of the die walls 2 and 3. On account of the inadequate cooling on the narrow sides of the strand 4, the strand shell 5 on the narrow sides of the strand 4 is not configured so as to be sufficiently strong. On account thereof, bulges are formed on the narrow sides of the strand 4 after the strand 4 has exited the die 1 and is in a secondary cooling in a strand casting installation.

The formation of concavities on the narrow sides of a strand can conventionally be minimized or eliminated, respectively, by reducing the conicity of the die. By contrast thereto, if it is established that the strand after passing through the die has bulges on the narrow sides, the conicity of the die is usually increased. However, if the bulges on the narrow sides of the strand are caused by an excessive conicity of the die according to FIG. 1C, the defect pattern of the longitudinal depressions on the broad sides of the strand are amplified on account of the further amplification of the conicity of the die for the intended reduction of the bulges, as is shown in FIG. 1D. This can lead to fissures on the strand shell on the base of the respective longitudinal depression, and under certain circumstances can lead to strand breakages in the region of the respective longitudinal depressions. The overall quality of the strand is reduced on account of the longitudinal depressions.

SUMMARY OF THE INVENTION

It is an object of the invention to improve the quality of a strand cast by a strand casting installation.

This object is achieved by a method and device as described below.

A method according to the invention of the type mentioned at the outset is characterized by the following steps:

- determining a centric temperature distribution curve along the centric measuring path from the temperature values measured along the centric measuring path;
- determining a peripheral temperature distribution curve along the peripheral measuring path from the temperature values measured along the peripheral measuring path;
- determining a first area under the centric temperature distribution curve, and a second area under the peripheral temperature distribution curve;
- determining a difference between the second area and the first area; and
- setting the conicity of the die while taking into account the difference.

According to the invention, a conclusion can be drawn from the difference between the second area under the peripheral temperature distribution curve and from the first area under the centric temperature distribution curve as to whether a concavity as described above, running in the longitudinal direction of the strand, is present within the die on one of the narrow sides of the cast strand that face the adjustably disposed die wall, said concavity being generated by an excessive conicity of the die and said concavity after the strand has exited the die potentially leading to a bulge being formed on the narrow side of the strand. An indicator for the presence of such a concavity is that the difference between the second area and the first area is a positive value. If it is detected that there is a concavity on the narrow side of the strand, the conicity of the die is a reduced instead of being increased, as is conventionally the case. The concavity on the narrow side is minimized or eliminated, respectively, by reducing the conicity of the die. It is simultaneously avoided, on account of the reduction of the conicity of the die, that peripheral longitudinal depressions are formed on the broad sides of the strand. Consequently, the strand can bear on the inside of the die walls of the die across the full area, on account of which said strand is guided in an optimal manner, and for configuring a uniformly strong strand shell is cooled in a uniform manner by means of the preferably water-cooled die walls. On account thereof, the formation of a bulge on the narrow side of the strand exiting the die is reliably prevented, said bulge being caused by the metal melt creeping within the strand. The creep of the metal melt within the strand in the region of the concavity is yet amplified in that a coarsening of the microstructure is present therein. Overall, a strand of higher quality can thus be produced.

The method according to the invention is carried out in-line, that is to say during the casting procedure. This enables the conicity of the die to be set in-line, on account of which a direct intervention in the strand production process can take place, and the production of rejects is significantly reduced. The method according to the invention is based on the insight that the bulges on the narrow sides of a strand exiting a die can be caused by concavities on the narrow sides within the die, said concavities being generated by an excessive conicity of the die, and that bulges generated in this manner cannot be minimized or eliminated, respectively, by way of a further amplification of the conicity of the die. By contrast thereto, it has been conventionally assumed that the conicity of the die in the case of bulges being present on the narrow sides of the strand exiting the die has to be amplified, this however further compromising the quality of the strand.

The centric measuring path runs in a central region, for example in a precisely centric manner, on the adjustably disposed die wall, specifically in the casting direction which in the context of the application is to be understood that the centric measuring path extends substantially parallel with a mathematical projection line which is created by a projection of the casting direction perpendicularly to the casting direction onto the die wall. The centric measuring path running along the adjustably disposed die wall herein is to be understood to mean that the centric measuring path extends across the entire length of the die wall provided in the casting direction, or only across part of said lengths. The temperature measurement values along the centric measuring path are detected at various measuring locations along the centric measuring path, wherein the measuring locations are mutually spaced apart in the longitudinal direction of the centric measuring path. The more measuring locations the centric measuring path has, the more precise the locational resolution, or the accuracy and the reliability, respectively, of the method. A separate sensor can be disposed at each measuring location, the signals of said sensor permitting a conclusion pertaining to the temperature at the respective measuring location. Alternatively, each measuring location can be connected by way of a separate optical conductor to a separate sensor that is remotely disposed, the signals of said sensor permitting a conclusion pertaining to the temperature at the respective measuring location. The signals of the sensors can be fed to an evaluation electronics system so as to be able to carry out the method according to the invention. Temperature measurement values in the context of the application are to be understood as directly measured temperature measurement values or temperature measurement values which are determined indirectly by way of another measured physical variable, wherein measuring the other physical variable in the context of the present application is referred to as measuring the temperature measurement values. The centric measuring path can run in a straight line, or at least in portions in a curved or meandering manner. In order for the measured data to be increased and/or in order for the redundancy of the temperature information detected to be improved, two or more respective centric measuring paths can also be present on the adjustably disposed die wall, temperature measurement values that are assigned to the respective centric measuring path being detected along said two or more measuring paths. Temperature measurement values can in each case be detected along centric measuring paths on both mutually opposite, adjustably disposed die walls, said temperature measurement values being able to be evaluated according to the method according to the invention. On account thereof, it can be detected on both adjustably disposed die walls whether the strand that is in contact therewith has a concavity running in the longitudinal direction, in order for the conicity of the die to be able to be adapted or optimized, respectively, while taking into account these items of information.

The peripheral measuring path runs in a peripheral region, that is to say in an eccentric manner, on the adjustably disposed die wall, specifically in the casting direction, this in the context of the application to be understood as meaning that the peripheral measuring path extends substantially parallel with a mathematical projection line which is created by a projection of the casting direction perpendicularly to the casting direction onto the die wall. The peripheral measuring path running along the adjustably disposed die wall herein is to be understood as meaning that the peripheral measuring path extends across the entire length of the die wall provided in the casting direction, or only across part of said length. The temperature measurement values along the peripheral measuring path are detected at various measuring locations along the peripheral measuring path, wherein the measuring locations are mutually spaced apart in the longitudinal direction of the peripheral measuring path. The more measuring locations the peripheral measuring path has, the more precise the locational resolution, or the accuracy and the reliability, respectively, of the method. A separate sensor can be disposed at each measuring location, the signals of said sensor permitting a conclusion pertaining to the temperature at the respective measuring location. Alternatively, each measuring location can be connected by way of a separate optical conductor to a separate sensor that is remotely disposed, the signals of said sensor permitting a conclusion pertaining to the temperature at the respective measuring location. The signals of the sensors can be fed to the evaluation electronics system so as to be able to carry out the method according to the invention. The peripheral measuring path can run in a straight line, or at least in portions in a curved or meandering manner. In order for the measured data to be increased and/or in order for the redundancy of the temperature information detected to be improved, two or more respective peripheral measuring paths can also be present on the adjustably disposed die wall, temperature measurement values that are assigned to the respective peripheral measuring path being detected along said two or more measuring paths. Temperature measurement values can in each case be detected along peripheral measuring paths on both mutually opposite, adjustably disposed die walls, said temperature measurement values being able to be evaluated according to the method according to the invention. On account thereof, it can be detected on both adjustably disposed die walls whether the strand that is in contact therewith has a concavity running in the longitudinal direction, in order for the conicity of the die to be able to be adapted or optimized, respectively, while taking into account these items of information.

The centric temperature distribution curve is generated from the temperature measurement values along the centric measuring path, specifically continuously or at discrete temporal points during the casting procedure. The centric temperature distribution curve can be illustrated in a temperature/measuring path diagram, wherein the centric measuring path is plotted on the axis of abscissas, while the temperature is plotted on the axis of ordinates. The centric temperature distribution curve can be determined by the interpolation of the measured temperature measurement values along the centric measuring path. The above-mentioned evaluation electronics system can be used to this end.

The peripheral temperature distribution curve is generated from the temperature measurement values along the peripheral measuring path, specifically continuously or at discrete temporal points during the casting procedure. The peripheral temperature distribution curve can be illustrated in a temperature/measuring path diagram, wherein the peripheral measuring path is plotted on the axis of abscissas, while the temperature is plotted on the axis of ordinates. The peripheral temperature distribution curve can be determined by the interpolation of the measured temperature measurement values along the peripheral measuring path. The above-mentioned evaluation electronics system can be used to this end.

The first area under the centric temperature distribution curve can be determined by the path integration of a locationally-dependent temperature function reflecting the centric temperature distribution curve by way of the centric measuring path. The second area under the peripheral temperature distribution curve can be determined by the path integration of a locationally-dependent temperature function reflecting the peripheral temperature distribution curve by way of the peripheral measuring path. The difference between the second area and the first area is preferably determined by subtracting the first area (subtrahend) from the second area (minuend). The first area can serve as the measure for the heat that is momentarily dissipated in a centric manner from the strand to the die wall. The second area can serve as the measure for the heat that is momentarily dissipated in a peripheral manner from the strand to the die wall.

A conclusion pertaining to the bearing behavior of the strand on the respective adjustably disposed die wall can be drawn from the difference between the second area and the first area. For example, if the second area which states the heat dissipated in a peripheral manner to the die wall is larger than the first area which states the heat dissipated in a centric manner to the die wall, it can be concluded that a concavity that runs in the longitudinal direction of the strand is present on the respective narrow side of the strand, or that the strand in the region of the concavity is not in contact with the die wall, respectively. The conicity of the die can then be reduced while taking into account the positive difference between the second area and the first area. By contrast, if the second area is smaller than the first area, it can be concluded that the peripheries of the respective narrow side of the strand are not in contact with the die wall. The conicity of the die can then be increased while taking into account the negative difference between the second area and the first area. If the second area is equal to the first area, it can be concluded that the strand bears everywhere on the die walls across the entire area. The conicity of the die can then be maintained while taking into account the difference having the value≅0 between the second area and the first area.

According to one advantageous design embodiment it is provided that the conicity of the die is increased when the difference is a negative value which is smaller than a pre-defined negative minimum value, that the conicity of the die is reduced when the difference is a positive value which is larger than a pre-defined positive minimum value, and that the conicity of the die is maintained when the difference is in an open interval, the upper limit thereof being the positive minimum value and the lower limit thereof being the negative minimum value. The positive minimum value and the negative minute value can be equal to zero or can differ from zero to only an insignificant extent.

According to a further advantageous design embodiment, the conicity of the die is varied more intensely the more the difference differs from zero. The larger the difference, the more obvious it is that the narrow side of the strand is partially in contact with the adjustably disposed die wall, and partially is disposed so as to be heavily spaced apart from the die wall, thus that a significant defective setting of the conicity of the die is provided. This then requires a more intense variation of the conicity of the die.

A device according to the invention of the type mentioned at the outset is characterized in that the actuation electronics system is specified for determining a centric temperature distribution curve along the centric measuring path from the temperature values measured along the centric measuring path, determining a peripheral temperature distribution curve along the peripheral measuring path from the temperature values measured along the peripheral measuring path, determining a first area under the centric temperature distribution curve and a second area under the peripheral temperature distribution curve, determining a difference between the second area and the first area; and setting the conicity of the die while taking into account the difference.

The advantages mentioned above in the context of the method are associated in analogous manner with the device. In particular, the device can be used for carrying out the method according to one of the above-mentioned design embodiments or any arbitrary combination of at least two of said design embodiments in an automated manner.

The mutually opposite, adjustably disposed die walls are preferably disposed on the narrow sides of the die. The conicity of the die can be varied by adjusting the mutually opposite walls. The adjustment of the mutually opposite die walls in particular comprises the adjustment of the inclination angles of the die walls.

The adjustment mechanism for adjusting the die walls can be hydraulic or electromechanical, for example. When the die walls of the narrow sides are clamped between the die walls on the broad sides of the die, the die walls on the broad sides of the die can first be de-stressed in order for the die walls on the narrow sides to be adjusted, so as to reduce the clamping forces. The die walls on the narrow sides can subsequently be adjusted, and the die walls on the broad sides can thereafter be reset to the original clamping force.

The centric sensor installation and the peripheral sensor installation can in each case be configured so as to be straight or elongate, respectively, and preferably extend in the casting direction. Each sensor installation comprises a plurality of sensors which can be connected to the respective die wall indirectly by way of optical conductors which can have a fiber Bragg grating, or directly. The so-called fiber Bragg gratings permit the use of the wavelength multiplexing method. On account thereof, many sensors having dissimilar Bragg wavelengths can be implemented along and in one optical conductor. In this way, a field from several dozen to one hundred sensors is implementable without the die walls having to be equipped with many individual punctiform sensors, which would be very complex in technical terms and would potentially weaken the structure of the die to an impermissible extent, and moreover by virtue of production-related deviations of the plunging depths of the individual sensors could lead to inaccuracies in the measurement. To this extent, optical conductors having integrated fiber Bragg gratings are extremely suitable. The sensor installations are connected to the actuation electronics system, and the former supply the measuring signals thereof to the latter. A uni-dimensional or multi-dimensional temperature field and/or heat flow density field can thus be provided to the actuation electronics system, wherefrom the actuation electronics system can compute the bearing behavior of the strand on the die. The actuation electronics system is moreover connected to the adjustment mechanism and specified for actuating the latter such that one or a plurality of adjustably disposed die walls can be set according to the determined bearing behavior of the strand.

According to one advantageous design embodiment, the actuation electronics system is specified for increasing the conicity of the die by actuating the adjustment mechanism when the difference is a negative value which is smaller than a pre-defined negative minimum value, for reducing the conicity of the die by actuating the adjustment mechanism when the difference is a positive value which is larger than a pre-defined positive minimum value, and for maintaining the conicity of the die without actuating the adjustment mechanism when the difference is in an open interval of which the upper limit is the positive minimum value, and of which the lower limit is the negative minimum value. The advantages mentioned above in the context of the respective design embodiment of the method are associated in an analogous manner with this design embodiment.

According to a further advantageous design embodiment, the actuation electronics system is specified for varying the conicity of the die by actuating the adjustment mechanism more intensely the more the difference differs from zero. The advantages mentioned above in the context of the respective design embodiment of the method are associated in an analogous manner with this design embodiment.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figures 1A, 1B, 1C, 1D:
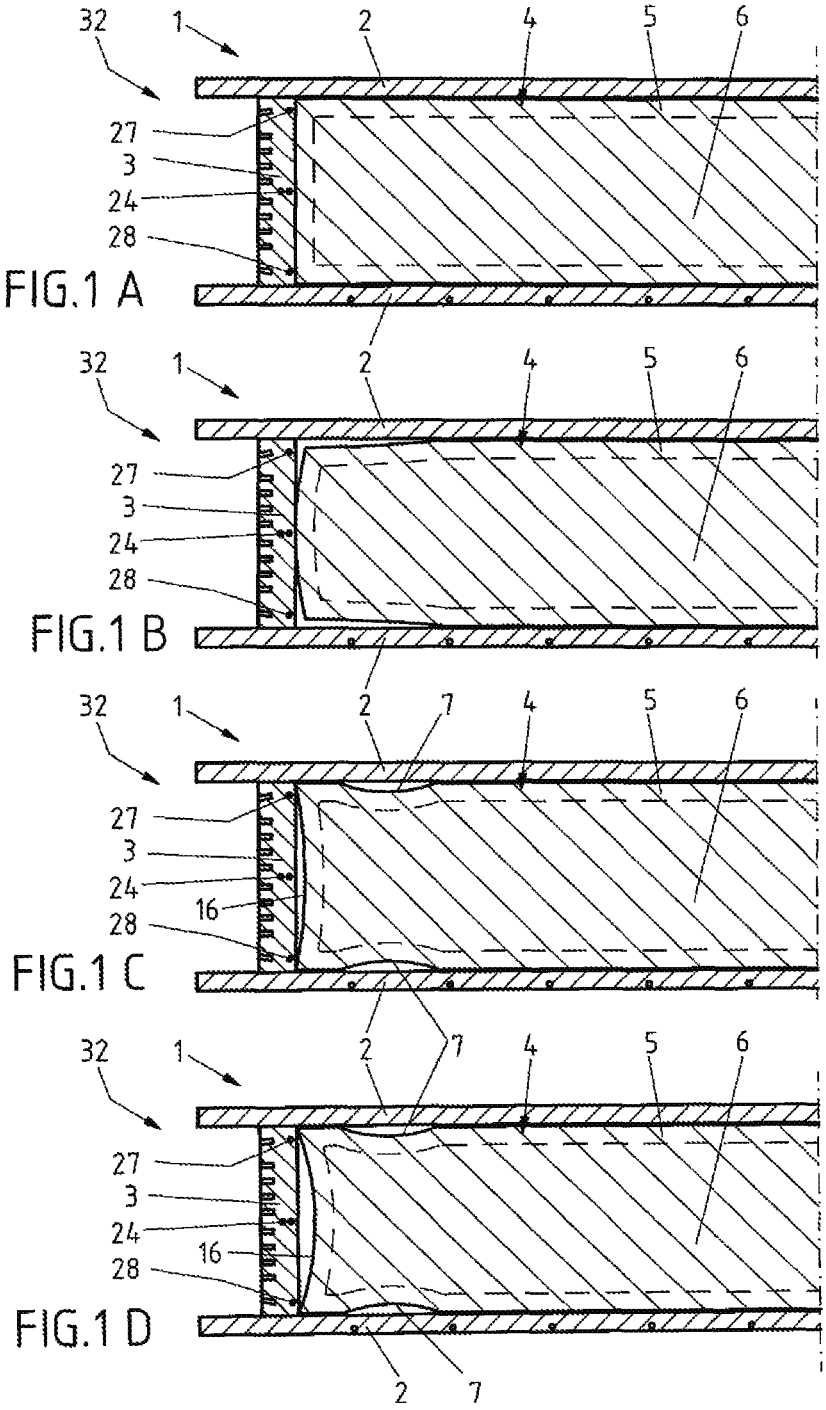
FIG. 1A shows a schematic sectional illustration of a portion of a die with an optimal conicity.
FIG. 1B shows a schematic sectional illustration of a portion of a die with an inadequate conicity.
FIG. 1C shows a schematic sectional illustration of a portion of a die with an excessive conicity.
FIG. 1D shows a schematic sectional illustration of a portion of a die with an overly excessive conicity.

The same components, or functionally equivalent components, respectively, are provided with the same reference signs in the figures. A repeat of the description of said components may be omitted.

FIGS. 1A to 1D show in each case a device 32 for a strand casting installation (not shown), in particular a slab strand casting installation.

The device 32 comprises a die 1 with mutually opposite, adjustably disposed die walls 3, disposed on narrow sides of the die 1, only one of said die walls 3 being shown in FIGS. 1A to 1D, and die walls 2 disposed on the broad sides of the die 1, the die walls 3 during a casting procedure being clamped between the die walls 2.

The device 32 furthermore comprises an adjustment mechanism (not shown) for adjusting the die walls 3, and an actuation electronics system (not shown) for actuating the adjustment mechanism.

Moreover, the device 32 comprises a first centric sensor installation 24, connected to the actuation electronics system, for measuring temperature values along a first centric measuring path running in a casting direction that runs transversely to the drawing plane along the adjustably disposed die wall 3, and a second centric sensor installation (not shown), connected to the actuation electronics systems, for measuring temperature values along a second centric measuring path running in the casting direction along the further adjustably disposed die wall (not shown).

The device 32 moreover comprises two peripheral sensor installations 27 and 28, connected to the actuation electronics system, for measuring temperature values along in each case one peripheral measuring path running in the casting direction along the adjustably disposed die wall 3, wherein each peripheral measuring path runs between the centric measuring path and a lateral periphery of the die wall 3, and a spacing of the respective peripheral measuring path from said lateral periphery of the die wall 3 is smaller than a spacing of the centric measuring path from the other lateral periphery of the die wall 3. The device 32 furthermore comprises two peripheral sensor installations (not shown), connected to the actuation electronics system, for measuring temperature values along in each case one peripheral measuring path running in the casting direction along the further adjustably disposed die wall (not shown), wherein each peripheral measuring path runs between the centric measuring path and a lateral periphery of the die wall, and a spacing of the respective peripheral measuring path from said lateral periphery of the die wall is smaller than a spacing of the centric measuring path from the other lateral periphery of the die wall.

The actuation electronics system is specified for determining a centric temperature distribution curve along the respective centric measuring path from the temperature values measured along the respective centric measuring path. The actuation electronics system is furthermore specified for determining a peripheral temperature distribution curve along the respective peripheral measuring path from the temperature values measured along the respective peripheral measuring path. The actuation electronics system is moreover specified for determining a first area under the respective centric temperature distribution curve and a second area under the respective peripheral temperature distribution curve. The actuation electronics system is furthermore specified for determining for each die wall 3 a difference between the second area and the respective first area. The actuation electronics system is furthermore specified for setting the conicity of the die 1 while taking into account the difference.

The actuation electronics system is specified for increasing the conicity of the die 1 when the respective difference is a negative value which is smaller than a pre-defined negative minimum value, for reducing the conicity of the die 1 when the respective difference is a positive value which is larger than a pre-defined positive minimum value, and for maintaining the conicity of the die 1 when the respective difference is in an open interval of which the upper limit is the positive minimum value, and of which the lower limit is the negative minimum value. In particular, the actuation electronics system is specified for varying the conicity of the die 1 more intensely the more the respective difference differs from zero.

Figure 2:
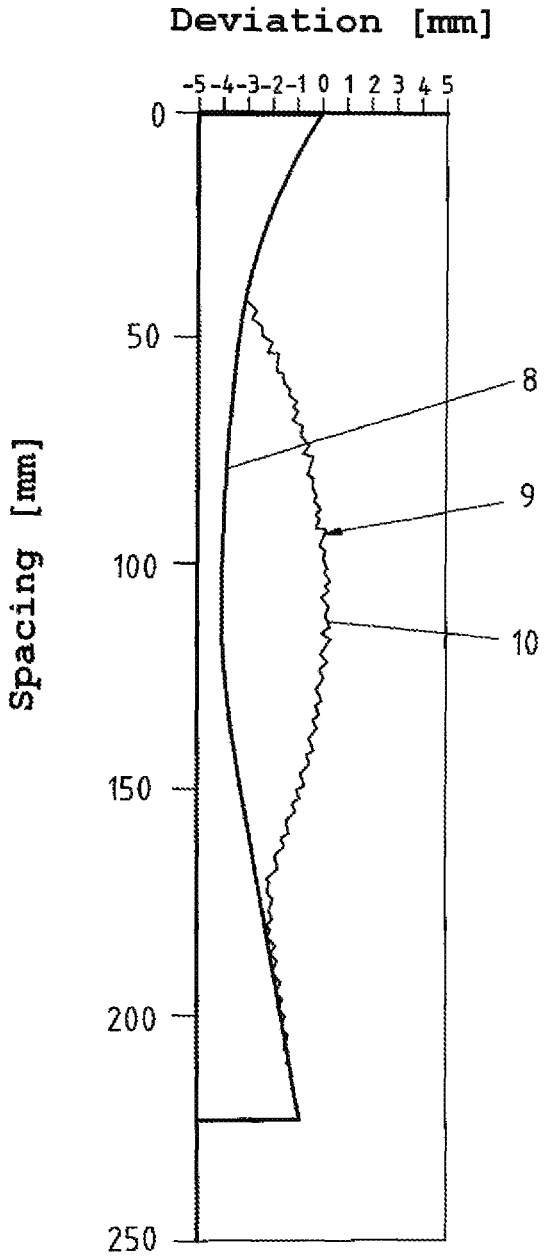
FIG. 2 shows a diagram which shows a narrow side shape of a cast strand within a die with an excessive conicity, and a narrow side shape of the strand outside the die.

FIG. 2 shows a diagram which shows a narrow side shape 8 of a cast strand within a die with an excessive conicity, and a narrow side shape 9 of the strand outside the die. The spacing along the narrow side from one broad side of the strand is plotted on the ordinate. The deviation from an ideal narrow side shape is plotted on the abscissa. The narrow side shape 8 is configured as a concavity which is generated by an excessive conicity of the die. Therefore, there is no contact with a die wall on a narrow side in a central region of the narrow side shape 8, on account of which the strand on the narrow side has a strand shell of which the thickness decreases in the direction of the center of the narrow side. When this strand exits the die, on account of the creep of the metal melt contained therein, and on account of the thinner configuration of the strand shell in the central region of the narrow side of the strand, a bulge 10 arises on the strand. This bulging of the narrow sides can be prevented by the method according to the invention, or the device according to the invention, respectively, in that it is detected whether there is a respective concavity on a narrow side of the strand within the die, the conicity of the die then being reduced if said concavity is present.

Figure 3:
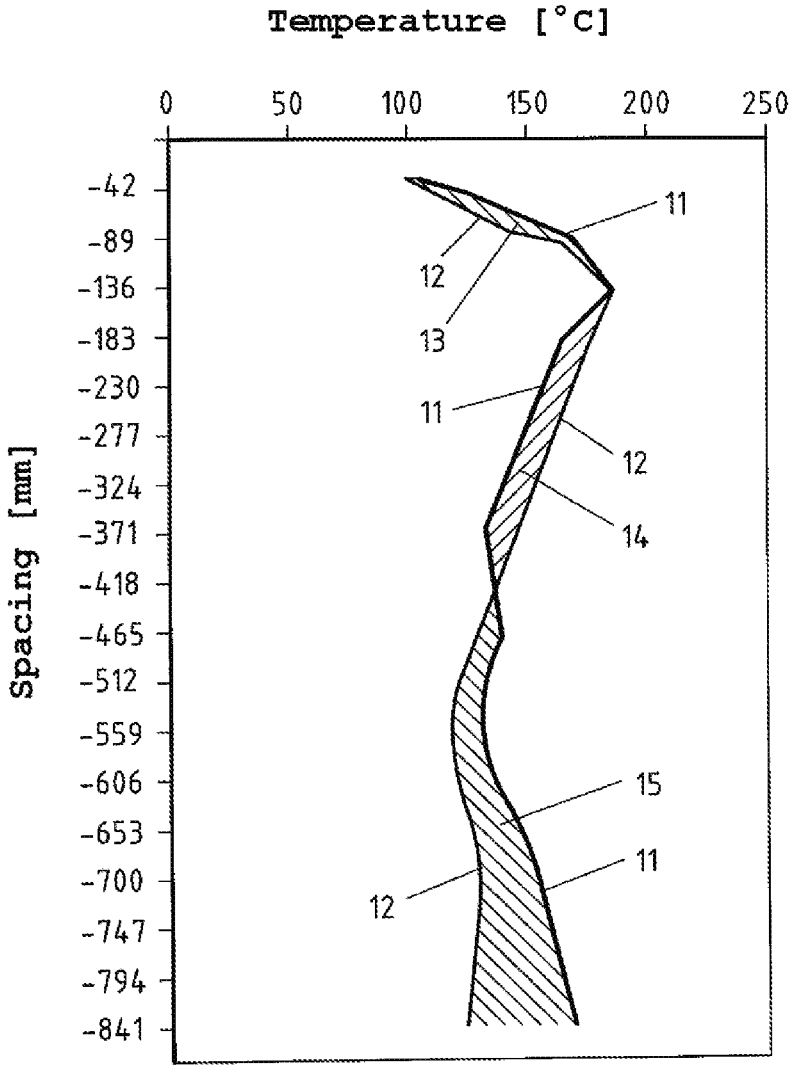
FIG. 3 shows a diagram which shows a centric temperature distribution curve and a peripheral temperature distribution curve.

FIG. 3 shows a diagram which shows a centric temperature distribution curve 11 and a peripheral temperature distribution curve 12. The spacing along the narrow side from a broad side of the strand is plotted on the ordinate. The temperature is plotted on the abscissa. The areas 13, 14, and 15 which represent the respective difference between the second temperature distribution curve 12 and the first temperature distribution curve 11 are present between the temperature distribution curves 11 and 12. The areas 13 and 15 herein are assigned to a negative difference, while the area 14 is assigned to a positive difference. This shows that even in the case of an optimal conicity of the die an inadequate conicity is usually provided in the entry region of the die (cf. area 13), while an excessive conicity can be provided in an adjoining region of the die (cf. area 14). This can be detected by the method according to the invention, or by the device according to the invention, respectively.

Figure 4:
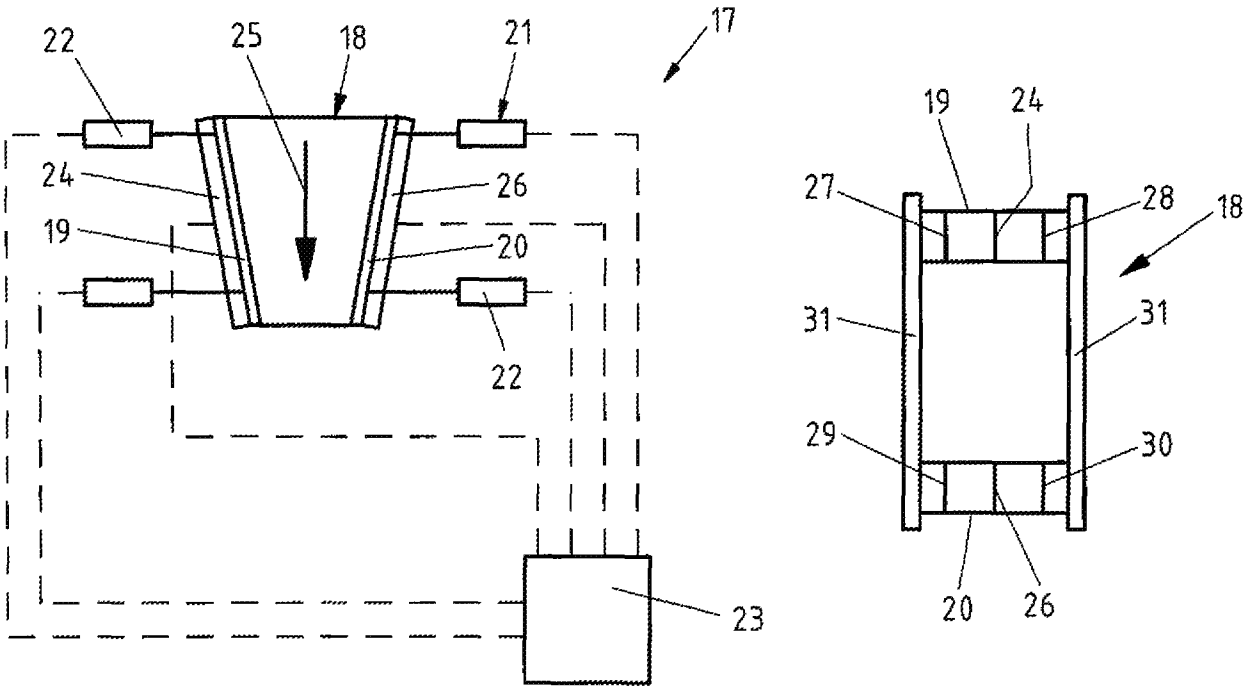
FIG. 4 shows a schematic illustration of an exemplary embodiment for a device according to the invention.

FIG. 4 shows a schematic illustration of an exemplary embodiment for a device 17 according to the invention for a strand casting installation (not shown), in particular a slab strand casting installation.

The device 17 comprises a die with mutually opposite, adjustably disposed die walls 19 and 20 which are disposed on narrow sides of the die 18. The die walls on the broad sides of the die 18 that are connected to said die walls 19 and 20 are not shown.

The device 18 moreover comprises an adjustment mechanism 21 for adjusting the die walls 19 and 20. The adjustment mechanism 21 for each adjustably disposed die wall 19 and 20, respectively, comprises two actuator drives 22, the inclination angle of the respective die wall 19 or 20, respectively, being variable by actuating said actuator drives 22.

The device 18 furthermore comprises an actuation electronics system 23 for actuating the adjustment mechanism 21. To this end, the actuation electronics system 23 is connected to the actuator drives 22 in a signal-technical manner.

The device 17 furthermore comprises a first centric sensor installation 24, connected to the actuation electronics system 23, for measuring temperature values along a first centric measuring path running in a casting direction (indicated by the arrow 25) along the adjustably disposed die wall 19, and a second centric sensor installation 26, connected to the actuation electronics system 23, for measuring temperature values along a second centric measuring path running in a casting direction (indicated by the arrow 25) along the adjustably disposed die wall 20.

The device 17 moreover comprises two peripheral sensor installations 27 and 28, connected to the actuation electronics system 23, for measuring temperature values along in each case one peripheral measuring path running in the casting direction along the adjustably disposed die wall 19, wherein each peripheral measuring path runs between the centric measuring path and a lateral periphery of the die wall 19, and a spacing of the respective peripheral measuring path from said lateral periphery of the die wall 19 is smaller than a spacing of the centric measuring path from the other lateral periphery of the die wall 19. The device 17 furthermore comprises two peripheral sensor installations 29 and 30, connected to the actuation electronics system 23, for measuring temperature values along in each case one peripheral measuring path running in the casting direction along the adjustably disposed die wall 20, wherein each peripheral measuring path runs between the centric measuring path and a lateral periphery of the die wall 20, and a spacing of the respective peripheral measuring path from said lateral periphery of the die wall 20 is smaller than a spacing of the centric measuring path from the other lateral periphery of the die wall 20. This is shown in the right-hand part of FIG. 4 which shows a view of the die 18 from above. Moreover, the die walls 31 on the broad sides of the die 18 are shown in the right-hand part of FIG. 4.

The actuation electronics system 23 is specified for determining a centric temperature distribution curve along the respective centric measuring path from the temperature values measured along the respective centric measuring path. The actuation electronics system 23 is furthermore specified for determining a peripheral temperature distribution curve along the respective peripheral measuring path from the temperature values measured along the respective peripheral measuring path. The actuation electronics system is moreover specified for determining a first area under the respective centric temperature distribution curve and a second area under the respective peripheral temperature distribution curve. The actuation electronics system 23 is furthermore specified for determining for each die wall 19 or 20, respectively, a difference between the second area and the respective first area. The actuation electronics system 23 is furthermore specified for setting the conicity of the die 18 while taking into account the differences.

The actuation electronics system 23 is specified for increasing the conicity of the die 18 by actuating the adjustment mechanism 21 when the respective difference is a negative value which is smaller than a pre-defined negative minimum value, for reducing the conicity of the die 18 by actuating the adjustment mechanism 21 when the respective difference is a positive value which is larger than a pre-defined positive minimum value, and for maintaining the conicity of the die 18 without actuating the adjustment mechanism 21 when the respective difference is in an open interval, the upper limit thereof being the positive minimum value and the lower limit thereof being the negative minimum value. In particular, the actuation electronics system 23 is specified for varying the conicity of the die 8 by actuating the adjustment mechanism 21 more intensely the more the respective difference differs from zero.

The entire disclosure of DE 10 2014 227 013 A1 is hereby incorporated by reference.

While specific embodiments of the invention have been shown and described in detail to illustrate the inventive principles, it will be understood that the invention may be embodied otherwise without departing from such principles.

We claim:

1. A method for setting a conicity of a die of a strand casting installation, during a casting procedure, comprising the steps of:

measuring temperature values along at least one centric measuring path running in a casting direction along an adjustably disposed die wall;

measuring temperature values along at least one peripheral measuring path running in a casting direction along the adjustably disposed die wall, wherein the at least one peripheral measuring path runs between the at least one centric measuring path and a lateral periphery of the die wall, wherein a spacing of the at least one peripheral measuring path from the lateral periphery of the die wall is smaller than a spacing of the at least one centric measuring path from an other lateral periphery of the die wall;

determining a centric temperature distribution curve along the at least one centric measuring path from the temperature values measured along the at least one centric measuring path;

determining a peripheral temperature distribution curve along the at least one peripheral measuring path from the temperature values measured along the at least one peripheral measuring path;

determining a first area under the centric temperature distribution curve, and a second area under the peripheral temperature distribution curve;

determining a difference between the second area and the first area; and setting the conicity of the die taking into account the difference.

2. The method according to claim 1, including:

increasing the conicity of the die when the difference is a negative value which is smaller than a pre-defined negative minimum value, reducing the conicity of the die when the difference is a positive value which is larger than a pre-defined positive minimum value, and maintaining the conicity of the die when the difference is in an open interval having an upper limit that is the positive minimum value and a lower limit that is the negative minimum value.

3. The method according to claim 2, including varying the conicity of the die more intensely the more the difference differs from zero.

* * * * *